United States Patent [19]

Sawaragi et al.

[11] Patent Number: 4,842,823

[45] Date of Patent: Jun. 27, 1989

[54] AUSTENITIC STEEL HAVING IMPROVED HIGH-TEMPERATURE STRENGTH AND CORROSION RESISTANCE

[75] Inventors: Yoshiatsu Sawaragi, Nishinomiya; Kunihiko Yoshikawa, Suita; Hiroshi Teranishi, Kobe, all of Japan

[73] Assignee: Sumitomo Metal Industries, Ltd., Osaka, Japan

[21] Appl. No.: 85,198

[22] Filed: Aug. 14, 1987

Related U.S. Application Data

[63] Continuation of Ser. No. 817,413, Jan. 9, 1986, abandoned.

[30] Foreign Application Priority Data

Jan. 10, 1985 [JP] Japan ..... 60-002457

[51] Int. Cl.[4] ..... C22C 30/00; C22C 19/05

[52] U.S. Cl. ..... 420/584; 420/586

[58] Field of Search ..... 420/584, 586, 452, 453; 148/419, 442

[56] References Cited

FOREIGN PATENT DOCUMENTS 55-21547 2/1980 Japan ..... 420/584

59-100301 6/1984 Japan ..... 420/584

2138446 10/1984 United Kingdom ..... 420/584

*Primary Examiner*—Deborah Yee

*Attorney, Agent, or Firm*—Burns, Doane, Swecker & Mathis

[57] ABSTRACT

An austenitic steel having improved high-temperature strength as well as corrosion resistance is disclosed. The steel consists essentially of, by weight %:

C: not more than 0.15%, Si: not more than 1.0%,

Mn: not more than 10%, Cr: 20–30%,

Ni: 30–55%, at least one of Mg and Ca in a total amount of 0.0010–0.0500%,

Mo: 0.5–6.0% and/or W: 1.0–12.0%, wherein

Mo(%)+1/2W(%)=0.5–6.0(%),

B: 0–0.0100%, Zr: 0–0.200%,

Ti: 0–0.30%, Nb: 0–1.00%,

V: 0–1.00%, and balance: Fe and incidental impurities, of which impurities P, S, and Al are restricted to:

P: not more than 0.020%,

S: not more than 0.010%, and

Al: not more than 0.030%,

P (%)+S (%)+Al (%) being less than 0.050%.

8 Claims, 3 Drawing Sheets

AUSTENITIC STEEL HAVING IMPROVED HIGH-TEMPERATURE STRENGTH AND CORROSION RESISTANCE

This application is a continuation, of application Ser. No. 817,413, filed Jan. 9, 1986, now abandoned.

BACKGROUND OF THE INVENTION

The present invention relates to an austenitic steel which exhibits not only improved corrosion resistance but also a satisfactory level of high-temperature strength. The austenitic steel of the present invention can exhibit improved high-temperature properties when used in boilers and chemical plant equipment operated at high temperatures.

In general, a satisfactory level of high-temperature strength, corrosion resistance, weldability, and other properties are required for materials which are used in a variety of boilers and chemical plant equipments which are operated at high temperatures. For these purposes, 18-8 type austenitic stainless steel has been widely used so far, since these properties are satisfied to a fair degree and it is not so expensive.

However, recently, a higher thermal efficiency has been required for these high-temperature applications and this higher efficiency has been achieved by higher operating temperatures. Accordingly, the materials used to manufacture these apparatuses have to resist more severe operating conditions. Thus, a higher level of performance has been required of the material, and this level of performance cannot be achieved using conventional 18-8 type austenitic stainless steel with respect to high-temperature strength and corrosion resistance.

It is generally well known in the art that an increase in the Cr content is effective to improve the corrosion resistance of a stainless steel. However, take SUS 310S (AISI 310S) steel as an example known at high Cr-steel, an increase in the Cr content does not always result in an increase in high-temperature strength, but sometimes adversely affects the high temperature strength.

Japanese Patent Application Laid-Open Specification No. 59-23855 discloses a steel with high-temperature strength containing carbide-forming elements. High-temperature properties of the steel disclosed therein are improved by finely dispersing carbides of Nb, Ti, Zr, and Ta, and the sulfur content should preferably be reduced to 0.010% or less in order to improve high-temperature strength and workability. However, the above reference does not mention about reduction in the amounts of impurities such as phosphorus and aluminum.

SUMMARY OF THE INVENTION

The object of the present invention is to provide a material which can exhibit not only improved corrosion resistance but also improved high-temperature strength, which are at levels higher than those of the conventional 18-8 type stainless steel which has generally been used in high temperature applications.

The inventors of the present invention have studied a high-Cr austenitic steel containing 20% or more of Cr so as to further improve its creep rupture strength.

The present invention resides in an austenitic steel having improved high-temperature strength as well as corrosion resistance, which consists essentially of, by weight %:

C: not more than 0.15%, Si: not more than 1.0%,
Mn: not more than 10%, Cr: 20–30%,
Ni: 30–55%,
at least one of Mg and Ca in a total amount of 0.0010–0.0500%,
Mo: 0.5–6.0% and/or W: 1.0–12.0%, wherein
Mo(%)+1/2W(%)=0.5–6.0(%),
B: 0–0.0100%, Zr: 0–0.200%,
Ti: 0–0.30%, Nb: 0–1.00%,
V: 0–1.00%, and
balance: Fe and incidental impurities, of which impurities P, S, and Al are restricted to:
P: not more than 0.020%,
S: not more than 0.010%, and
Al: not more than 0.030%,
P(%)+S(%)+Al(%) being less than 0.050%.

According to preferred embodiments of the present invention, optional alloying elements such as B, Zr, Ti, Nb, and V each in the following amounts may be intentionally added so as to further improve high-temperature properties:
B: 0.001–0.010%,
Zr: 0.005–0.200%,
Ti: 0.01–0.30%,
Nb: 0.01–1.00%, and
V: 0.01–1.00.

Thus, according to the present invention, not only the resistance to corrosion but also the high-temperature strength can be improved.

DETAILED DESCRIPTION OF THE PREFERRED EMBODIMENTS

Figure 1:
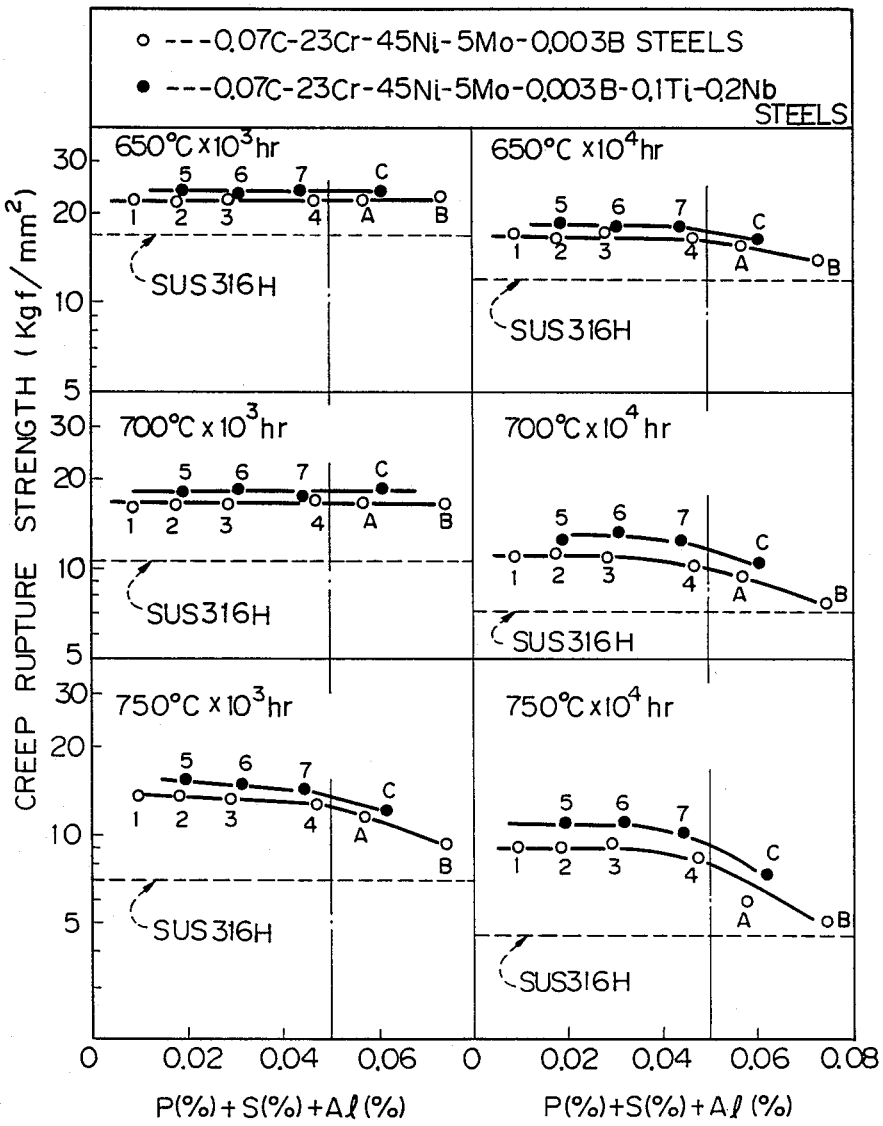
FIGS. 1 and 2 are graphs showing the effect of the total content of P, S, and Al on the creep rupture strength of steel.

The reasons why the steel composition of the austenitic steel of the present invention has been defined as in the above will now be described in more detail.

Carbon (C):

The addition of carbon is necessary to attain a requisite level of tensile strength and creep rupture strength which are required for heat resistant steels. However, when the carbon content is higher than 0.15%, ductility decreases and the amount of carbides which are not dissolved in a matrix after solution treatment increases resulting in a degradation in mechanical properties. Therefore, according to the present invention the carbon content is defined as not more than 0.15%, and preferably 0.05–0.10%.

Silicon (Si):

Silicon is effective as a deoxidizing agent. A silicon content higher than 1.0% markedly impairs weldability and stability in a metallurgical structure. Therefore, the Si content is restricted to not more than 1.0%.

From the viewpoint of metallurgical structural stability, it is desirable to restrict the Si content to the lower end of the range of the present invention.

Manganese (Mn):

Manganese acts as an oxidizing agent and also as an agent to improve workability. However, when the Mn content is more than 10%, the heat resistant properties are degraded, and therefore the Mn content is defined as not more than 10% in the present invention.

Chromium (Cr):

Chromium can provide improved resistance to oxidation and steam oxidation as well as resistance to high temperature corrosion.

When the Cr content is lower than 20%, these properties cannot be satisfactorily exhibited. On the other hand, when the Cr content is more than 30%, a degradation in workability as well as instability in the metallurgical structure are inevitable. Therefore, the Cr content is defined as 20–30%, and preferably 22–26%.

Nickel (Ni):

It is essential to add nickel in order to attain an austenitic steel with a stable structure. The Ni content required for this purpose depends on the content of Cr, Mo, W, Ti, and Nb.

However, when the Ni content is smaller than 30%, it is not possibly to attain a stable metallurgical structure of austenite with certainty. In contrast, when the Ni content is over 55%, the material obtained is expensive. Thus, according to the present invention, the Ni content is restricted to 30–55%, preferably 35–50%.

Magnesium and Calcium (Mg and Ca):

These elements act as oxidizing agents and also as agents to improve workability. They are also effective to improve creep strength. At least one of them must be added to achieve the purpose of the present invention. These elements are particularly important to the present invention, since the addition of aluminum as an oxidizing agent is prevented. When these elements are added in a total amount of less than 0.0010%, the intended effect thereof cannot be attained. On the other hand, when the content of these elements is over 0.0500%, the workability degrades to some extent. Therefore, the total content of Mg and Ca is defined as 0.0010–0.0500%, and preferably 0.0020–0.0200%.

Molybdenum and Tungsten (Mo and W):

These elements are useful in improving high-temperature strength effectively, and one or more of these elements are added for that purpose.

When either of these elements is added, Mo in an amount of at least 0.5% or W in an amount of at least 1.0% is necessary to obtain the intended effect. In general, the formula Mo(%)+1/2W(%) should have a value of not smaller than 0.5%. On the other hand, when the molybdenum content is more than 6.0%, or the W content is more than 12.0%, if either of these elements is added alone, the workability as well as stability in a metallurgical structure is impaired. In general, the formula Mo(%)+1/2W(%) should have a value of not more than 6(%).

Thus, the Mo content is defined as 0.5–6.0%, and the W content is 1.0–12.0%. In general, the formula Mo(%)+1/2W(%) is equal to 0.5–6(%), and preferably 2–5%.

Boron and Zirconium (B and Zr):

These elements have an effect of strengthening the grain boundary, resulting in an improvement in high-temperature strength. Therefore, when it is desirable to further improve high-temperature strength, at least one of these elements is added. When the added amount of B is less than 0.0010%, or the amount of Zr is less than 0.005%, the intended effect cannot be attained sufficiently. On the other hand, when B in an amount of more than 0.010% or Zr in an amount of more than 0.200% is added, weldability degrades. Therefore, according to the present invention, the content thereof is restricted to 0.0010–0.0100% for B and 0.005–0.200% for Zr, when one or both of these elements are added.

Titanium, Niobium, and Vanadium (Ti, Nb and V):

These elements are effective in carrying out precipitation hardening due to their carbides capable of being finely dispersed in an austenitic matrix so that high-temperature strength is markedly improved. Therefore, when high-temperature strength needs to be further improved, these elements are added optionally. When each of these elements is added in an amount of less than 0.01%, there is no appreciable effect. However, when Ti in an amount of more than 0.30%, Nb in an amount of more than 1.00%, and V in an amount of more than 1.00% are added, no further improvement in the properties mentioned above can be expected. Therefore, the Ti content is defined as 0.01–0.30%, the Nb content as 0.01–1.00%, and the V content as 0.01–1.00%, when one or more of them are added.

Phosphorus, Sulfur, and Aluminum (P, S and Al):

Phosphorus and sulfur are impurities which are inevitably included in steels. In general, for a conventional steel, the level of these impurities is 0.025% for P and 0.005%–0.015% for S. Aluminum is also one impurity which is inevitably included in steels.

According to the findings of the inventors of the present invention, when the P content is over 0.020%, the S content is over 0.010%, the Al content is over 0.030%, or their total content is over 0.050%, the high-temperature creep strength over a prolonged period degrades at a temperature of 650°–750° C.

Therefore, according to the present invention, the P content is restricted to not more than 0.020%, the S content to not more than 0.010%, the Al content to not more than 0.030%, and their total content is defined as follows:

$$P(\%)+S(\%)+Al(\%)<0.050\%$$

Furthermore, a low content of P and S as defined above is desirable from a viewpoint of improving weldability.

Preferably, the P content is restricted to not more than 0.015%, the S content to not more than 0.003%, the Al content to not more than 0.020%, and the total content of P+S+Al to less than 0.035%.

The present invention will now be further described in conjunction with the following working examples of the present invention, which are presented merely for illustrative purposes.

EXAMPLES

Steel Nos. 1–24 of the present invention and Comparative Steels A through Q having the steel compositions shown in Table 1 were subjected to vacuum melting, forging, and cold working. The resulting steels were then subjected to a solid solution treatment at 1200° C. and cut for a creep rupture test.

The creep rupture test was carried out at the temperatures of 650° C., 700° C., and 750° C. The creep rupture strengths for $10^3$ hours and $10^4$ hours at each of these temperatures were determined. The test results are shown in Table 2.

Figure 2:
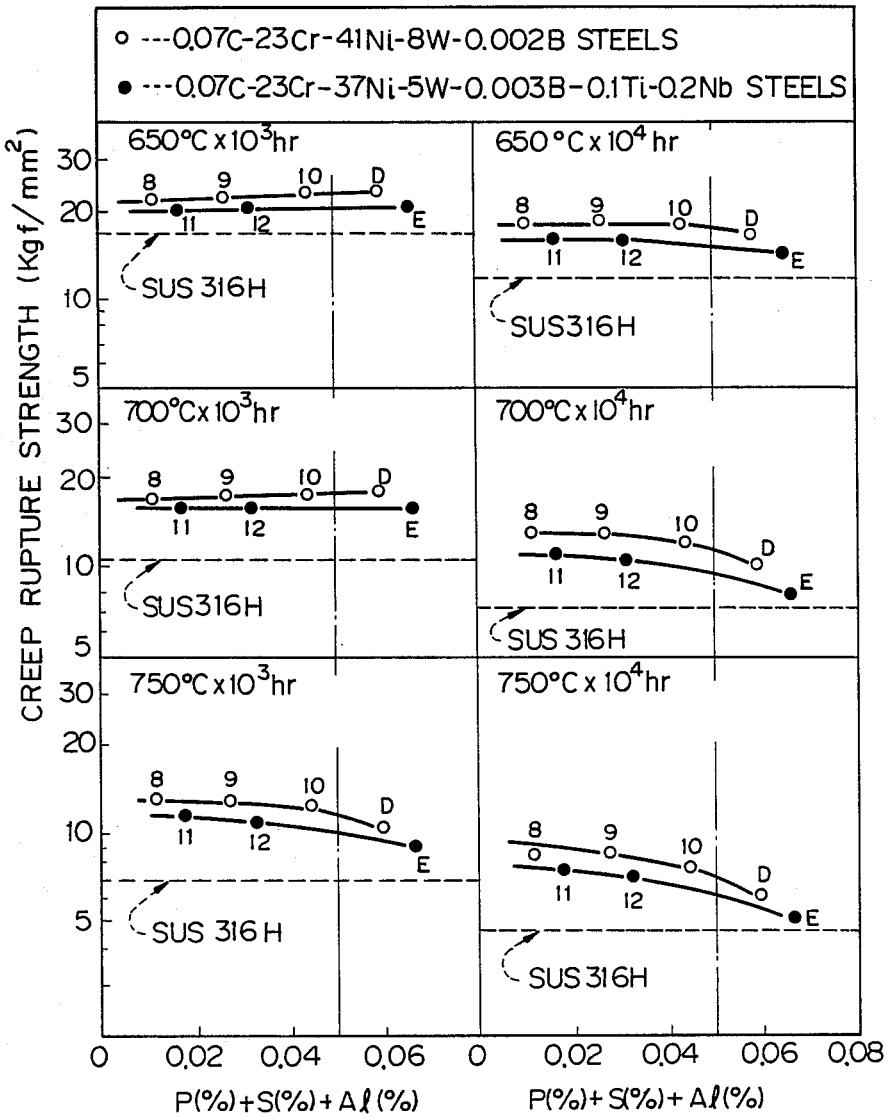

FIGS. 1 and 2 are graphs showing the effect of the value of [P(%)+S(%)+Al(%)] on the creep rupture strength, the graphs being prepared on the basis of the data shown in Table 2. The numeral and alphabetical references shown in the graphs indicate the steel numbers or marks in Table 1.

Figure 3:
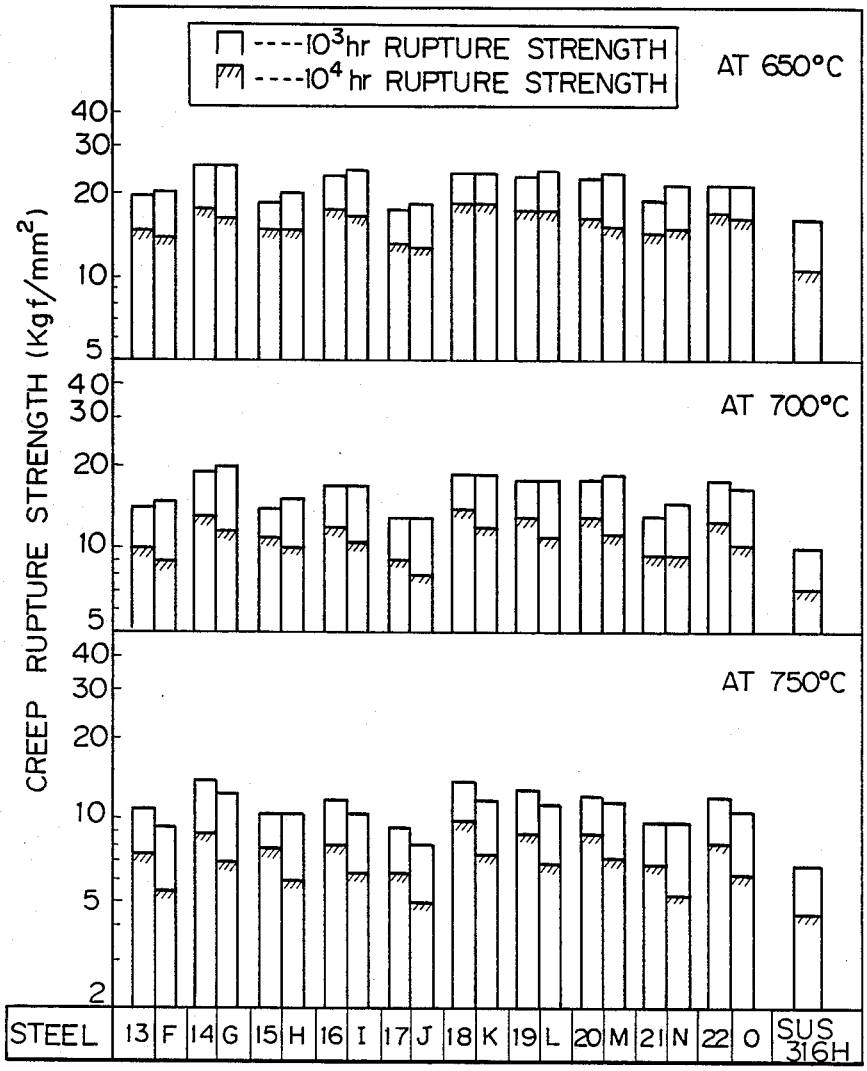
FIG. 3 shows data on the creep rupture strength of steel, which were obtained from the working examples of the present specification.

FIG. 3 is also a graph which summarizes the data shown in Table 2 and compares the creep rupture strength of the steel of the present invention with that of the comparative steels.

As is apparent from the above, Steels 1–24 of the present invention exhibited creep rupture strengths which were higher than that of SUS 316, which is thought to have the highest creep rupture strength of 18-8 type austenitic stainless steels (SUS 304H, SUS 316H, SUS321H, and SUS 347H), and 25Cr-20Ni type stainless steels (SUS 310S).

In addition, it is apparent from FIG. 1 that the rupture strength for $10^3$ hours at 650° C. is substantially the same as that at 700° C., regardless of the steel compositions. In this respect, there is no sigificant difference between the steel of the present invention and the comparative one. On the contrary, some examples of the comparative steels exhibited a strength higher than that of the steel composition of the present invention.

However, as for the creep rupture strength for $10^3$ hours at 750° C., and that for $10^4$ hours at 650°–750° C., there was a significant difference between the steel of the present invention and the comparative steel.

When the value of the formula [P(%)+S(%)+Al(%)] is 0.050% or higher, a marked decrease in the creep rupture strength is noted compared with when the value of the formula is smaller than 0.050%.

The same phenomenon has been confirmed concerning the other steel compositions shown in FIG. 3, and that the steel of the present invention can exhibit better resistance to corrosion than that exhibited by a conventional 18-8 type stainless steel, since the Cr content of the steel of the present invention is rather high.

Thus, impurities such as P, S, and Al in an austenitic steel containing 20–30% of Cr have a great influence on the creep rupture strength. Particularly, restricting the total amount of these impurities to smaller than 0.050% according to the present invention can make a great contribution to improving high-temperature, long-term creep rupture strength, resulting in an austenitic steel with improved high-temperature strength as well as improved resistance to corrosion.

Although the present invention has been described with respect to preferred embodiments, it is to be understood that variations and modifications may be employed without departing from the concept of the present invention as defined in the following claims.

TABLE 1

| Steel No. | Chemical composition (% by weight) | | | | | | | | |
|---|---|---|---|---|---|---|---|---|---|
| | C | Si | Mn | P | S | Cr | Ni | Mg | Ca |
| This Invention | | | | | | | | | |
| 1 | 0.07 | 0.25 | 1.06 | 0.003 | 0.001 | 23.15 | 44.20 | 0.0078 | — |
| 2 | 0.07 | 0.28 | 1.10 | 0.010 | 0.001 | 22.86 | 42.68 | 0.0065 | — |
| 3 | 0.08 | 0.30 | 1.10 | 0.017 | 0.001 | 23.36 | 43.61 | 0.0095 | — |
| 4 | 0.07 | 0.26 | 1.07 | 0.019 | 0.001 | 23.16 | 45.05 | 0.0042 | — |
| 5 | 0.07 | 0.35 | 1.36 | 0.010 | 0.003 | 24.01 | 46.10 | 0.0048 | — |
| 6 | 0.08 | 0.40 | 1.28 | 0.015 | 0.002 | 23.28 | 46.10 | 0.0062 | — |
| 7 | 0.08 | 0.40 | 1.28 | 0.018 | 0.004 | 23.28 | 45.85 | 0.0062 | — |
| 8 | 0.06 | 0.26 | 1.12 | 0.003 | 0.001 | 22.56 | 40.94 | 0.0040 | — |
| 9 | 0.07 | 0.26 | 1.18 | 0.010 | 0.002 | 23.01 | 41.24 | 0.0051 | — |
| 10 | 0.07 | 0.30 | 1.18 | 0.017 | 0.003 | 22.84 | 40.85 | 0.0040 | — |
| 11 | 0.08 | 0.45 | 1.46 | 0.005 | 0.002 | 23.45 | 36.50 | — | 0.015 |
| 12 | 0.08 | 0.44 | 1.38 | 0.009 | 0.003 | 23.60 | 36.30 | — | 0.016 |
| 13 | 0.08 | 0.28 | 1.20 | 0.015 | 0.002 | 23.06 | 38.90 | 0.0061 | — |
| 14 | 0.07 | 0.30 | 5.34 | 0.008 | 0.003 | 23.06 | 49.50 | 0.0086 | — |
| 15 | 0.09 | 0.30 | 1.00 | 0.013 | 0.002 | 21.00 | 35.20 | 0.0040 | — |
| 16 | 0.05 | 0.21 | 0.92 | 0.018 | 0.003 | 25.95 | 43.74 | 0.0065 | — |
| 17 | 0.03 | 0.12 | 0.65 | 0.012 | 0.003 | 20.32 | 31.25 | 0.0135 | — |
| 18 | 0.13 | 0.86 | 1.62 | 0.016 | 0.006 | 28.80 | 53.62 | 0.0120 | — |
| 19 | 0.08 | 0.30 | 1.24 | 0.013 | 0.002 | 25.24 | 47.10 | 0.0080 | — |
| 20 | 0.07 | 0.41 | 1.23 | 0.010 | 0.003 | 25.31 | 47.00 | 0.0050 | — |
| 21 | 0.06 | 0.34 | 7.76 | 0.007 | 0.004 | 26.87 | 31.21 | 0.0020 | — |
| 22 | 0.07 | 0.04 | 0.13 | 0.012 | 0.001 | 22.86 | 39.86 | 0.0218 | — |
| 23 | 0.07 | 0.14 | 1.00 | 0.011 | 0.001 | 25.10 | 45.34 | — | 0.024 |
| 24 | 0.09 | 0.30 | 1.28 | 0.010 | 0.002 | 24.55 | 46.10 | — | 0.038 |
| Comparative | | | | | | | | | |
| A | 0.08 | 0.30 | 1.00 | 0.023* | 0.002 | 23.06 | 44.31 | 0.0080 | — |
| B | 0.07 | 0.32 | 1.16 | 0.027* | 0.002 | 23.16 | 44.86 | 0.0056 | — |
| C | 0.08 | 0.36 | 1.30 | 0.025* | 0.002 | 23.16 | 46.21 | 0.0070 | — |
| D | 0.07 | 0.28 | 1.14 | 0.017 | 0.003 | 22.96 | 40.85 | 0.0096 | — |
| E | 0.08 | 0.44 | 1.42 | 0.045* | 0.003 | 23.51 | 37.10 | — | 0.012 |
| F | 0.08 | 0.28 | 1.30 | 0.027* | 0.015* | 23.25 | 38.70 | 0.0070 | — |
| G | 0.08 | 0.32 | 5.18 | 0.018 | 0.008 | 23.42 | 50.03 | 0.0045 | — |
| H | 0.08 | 0.28 | 1.06 | 0.042* | 0.002 | 20.86 | 35.30 | 0.0045 | — |
| I | 0.05 | 0.18 | 0.86 | 0.025* | 0.012* | 25.74 | 44.25 | 0.0060 | — |
| J | 0.03 | 0.14 | 0.60 | 0.025* | 0.005 | 20.16 | 31.50 | 0.0081 | — |
| K | 0.13 | 0.90 | 1.57 | 0.017 | 0.005 | 28.72 | 53.86 | 0.0050 | — |
| L | 0.08 | 0.32 | 1.18 | 0.032* | 0.003 | 24.98 | 46.86 | 0.0028 | — |
| M | 0.08 | 0.36 | 1.16 | 0.032* | 0.003 | 25.12 | 46.76 | 0.0036 | — |
| N | 0.06 | 0.31 | 7.92 | 0.040* | 0.004 | 27.51 | 30.16 | 0.0017 | — |
| O | 0.07 | 0.04 | 0.16 | 0.023* | 0.008 | 23.04 | 40.12 | 0.0203 | — |
| P | 0.07 | 0.12 | 0.96 | 0.036* | 0.003 | 24.96 | 44.87 | — | 0.022 |
| Q | 0.09 | 0.35 | 1.61 | 0.027* | 0.007 | 24.32 | 47.10 | — | 0.040 |

| Steel No. | Chemical composition (% by weight) | | | | | | | | |
|---|---|---|---|---|---|---|---|---|---|
| | Mo | W | B | Zr | Ti | Nb | V | Al | Fe + others |
| This Invention | | | | | | | | | |
| 1 | 4.95 | — | 0.0028 | — | — | — | — | 0.006 | Bal. |
| 2 | 5.04 | — | 0.0032 | — | — | — | — | 0.008 | " |
| 3 | 4.83 | — | 0.0032 | — | — | — | — | 0.012 | " |

TABLE 1-continued

| | | | | | | | | | |
|---|---|---|---|---|---|---|---|---|---|
| 4 | 4.86 | — | 0.0025 | — | — | — | — | 0.028 | " |
| 5 | 5.36 | — | 0.0038 | — | 0.07 | 0.16 | — | 0.007 | " |
| 6 | 5.21 | — | 0.0030 | — | 0.10 | 0.18 | — | 0.015 | " |
| 7 | 5.21 | — | 0.0026 | — | 0.07 | 0.18 | — | 0.023 | " |
| 8 | — | 8.04 | 0.0017 | — | — | — | — | 0.008 | " |
| 9 | — | 7.84 | 0.0020 | — | — | — | — | 0.016 | " |
| 10 | — | 7.90 | 0.0023 | — | — | — | — | 0.025 | " |
| 11 | — | 5.16 | 0.0028 | — | 0.11 | 0.22 | — | 0.011 | " |
| 12 | — | 5.00 | 0.0028 | — | 0.12 | 0.22 | — | 0.021 | " |
| 13 | 3.06 | — | — | — | — | — | — | 0.010 | " |
| 14 | 5.76 | — | — | — | — | 0.85 | — | 0.025 | " |
| 15 | 2.05 | — | — | — | 0.27 | — | — | 0.018 | " |
| 16 | — | 8.20 | — | — | 0.17 | 0.40 | — | 0.013 | " |
| 17 | 0.72 | — | 0.0023 | — | — | — | — | 0.018 | " |
| 18 | — | 11.60 | 0.0092 | — | — | — | — | 0.012 | " |
| 19 | 2.75 | 5.30 | 0.0065 | — | — | — | — | 0.024 | " |
| 20 | 2.50 | 4.86 | — | 0.084 | — | — | — | 0.016 | " |
| 21 | — | 1.35 | 0.0047 | 0.150 | 0.03 | 0.04 | 0.16 | 0.018 | " |
| 22 | — | 7.92 | — | — | 0.08 | 0.19 | — | 0.004 | " |
| 23 | — | 8.45 | 0.0035 | — | — | — | 0.34 | 0.010 | " |
| 24 | 5.18 | — | 0.0017 | — | 0.07 | 0.22 | — | 0.021 | " |
| Comparative | | | | | | | | | |
| A | 5.01 | — | 0.0030 | — | — | — | — | 0.033* | " |
| B | 4.96 | — | 0.0034 | — | — | — | — | 0.046* | " |
| C | 5.28 | — | 0.0035 | — | 0.09 | 0.17 | — | 0.035* | " |
| D | — | 8.16 | 0.0019 | — | — | — | — | 0.040* | " |
| E | — | 5.08 | 0.0030 | — | 0.10 | 0.21 | — | 0.019 | " |
| F | 3.24 | — | — | — | — | — | — | 0.024 | " |
| G | 5.61 | — | — | — | — | 0.88 | — | 0.063* | " |
| H | 2.16 | — | — | — | 0.26 | — | — | 0.020 | " |
| I | — | 8.48 | — | — | 0.15 | 0.42 | — | 0.038* | " |
| J | 0.75 | — | 0.0025 | — | — | — | — | 0.048* | " |
| K | — | 11.46 | 0.0088 | — | — | — | — | 0.067* | " |
| L | 2.60 | 5.42 | 0.0065 | — | — | — | — | 0.028 | " |
| M | 2.36 | 5.24 | — | 0.076 | — | — | — | 0.042* | " |
| N | — | 1.40 | 0.0060 | 0.170 | 0.02 | 0.04 | 0.18 | 0.011 | " |
| O | — | 8.04 | — | — | 0.08 | 0.19 | — | 0.050* | " |
| P | — | 8.60 | 0.0036 | — | — | — | 0.32 | 0.025 | " |
| Q | 5.04 | — | 0.0018 | — | 0.07 | 0.23 | — | 0.040* | " |

Note:
*Outside the present invention.

TABLE 2

| Steel | Creep rupture strength (kgf/mm$^2$) | | | | | |
|---|---|---|---|---|---|---|
| | 650° C. | | 700° C. | | 750° C. | |
| No. | $10^3$ hr | $10^4$ hr | $10^3$ hr | $10^4$ hr | $10^3$ hr | $10^4$ hr |
| This Invention | | | | | | |
| 1 | 22.0 | 17.0 | 16.0 | 11.2 | 13.5 | 9.0 |
| 2 | 21.5 | 16.5 | 16.5 | 11.5 | 13.3 | 9.0 |
| 3 | 22.2 | 17.5 | 16.5 | 11.0 | 13.0 | 9.5 |
| 4 | 22.0 | 16.5 | 17.0 | 10.3 | 12.5 | 8.5 |
| 5 | 23.5 | 18.5 | 18.0 | 13.0 | 14.8 | 11.0 |
| 6 | 23.0 | 18.0 | 18.3 | 13.5 | 14.5 | 11.0 |
| 7 | 23.5 | 18.0 | 17.5 | 12.5 | 14.0 | 10.5 |
| 8 | 22.0 | 18.0 | 17.0 | 13.0 | 13.0 | 8.5 |
| 9 | 22.2 | 18.5 | 17.5 | 13.0 | 13.0 | 8.5 |
| 10 | 23.0 | 18.0 | 17.5 | 12.0 | 12.5 | 7.5 |
| 11 | 20.0 | 16.0 | 16.0 | 11.0 | 10.5 | 7.4 |
| 12 | 20.5 | 16.0 | 16.0 | 10.5 | 10.0 | 7.0 |
| 13 | 20.0 | 15.0 | 14.0 | 10.0 | 11.0 | 7.4 |
| 14 | 26.0 | 18.0 | 19.0 | 13.0 | 14.0 | 9.0 |
| 15 | 19.0 | 15.0 | 14.0 | 11.0 | 10.5 | 7.8 |
| 16 | 24.0 | 18.0 | 17.0 | 12.0 | 12.0 | 8.0 |
| 17 | 18.0 | 13.5 | 13.0 | 9.2 | 9.5 | 6.4 |
| 18 | 25.0 | 19.0 | 19.0 | 14.0 | 14.0 | 10.0 |
| 19 | 24.0 | 18.0 | 18.0 | 13.0 | 13.0 | 9.0 |
| 20 | 24.0 | 17.0 | 18.0 | 13.0 | 12.5 | 9.0 |
| 21 | 20.0 | 15.0 | 13.5 | 9.6 | 10.0 | 7.0 |
| 22 | 23.0 | 18.0 | 18.0 | 13.0 | 12.5 | 8.4 |
| 23 | 23.0 | 17.5 | 17.8 | 12.3 | 12.5 | 8.2 |
| 24 | 23.0 | 18.0 | 18.3 | 13.5 | 13.8 | 11.0 |
| Comparative | | | | | | |
| A | 22.2 | 15.5 | 16.5 | 9.5 | 11.5 | 6.0 |
| B | 22.5 | 14.0 | 16.5 | 7.7 | 9.3 | 5.2 |
| C | 23.5 | 16.5 | 18.5 | 10.5 | 12.0 | 7.4 |
| D | 23.0 | 16.5 | 18.0 | 10.2 | 10.3 | 6.0 |
| E | 20.5 | 14.5 | 15.5 | 8.0 | 9.0 | 5.0 |
| F | 21.0 | 14.0 | 14.5 | 9.0 | 9.5 | 5.5 |

TABLE 2-continued

| Steel | Creep rupture strength (kgf/mm$^2$) | | | | | |
|---|---|---|---|---|---|---|
| | 650° C. | | 700° C. | | 750° C. | |
| No. | $10^3$ hr | $10^4$ hr | $10^3$ hr | $10^4$ hr | $10^3$ hr | $10^4$ hr |
| G | 26.0 | 16.5 | 20.0 | 11.3 | 12.3 | 7.0 |
| H | 21.0 | 15.0 | 15.0 | 10.0 | 10.5 | 6.0 |
| I | 25.0 | 17.0 | 17.0 | 10.5 | 10.5 | 6.4 |
| J | 19.0 | 13.0 | 13.0 | 8.0 | 8.2 | 5.0 |
| K | 25.0 | 19.0 | 19.0 | 12.0 | 12.0 | 7.5 |
| L | 25.2 | 18.0 | 18.0 | 11.0 | 11.5 | 7.0 |
| M | 25.0 | 16.0 | 19.0 | 11.5 | 12.0 | 7.4 |
| N | 23.0 | 15.5 | 15.0 | 9.6 | 10.0 | 5.4 |
| O | 23.0 | 17.0 | 17.0 | 10.5 | 11.0 | 6.4 |
| P | 23.0 | 16.5 | 17.0 | 10.3 | 10.8 | 6.4 |
| Q | 23.2 | 16.5 | 18.0 | 11.0 | 12.0 | 7.0 |

What is claimed is:

1. An alloy having improved high-temperature strength and corrosion resistance, which consists essentially of, by weight %:

C: not more than 0.15%; Si: not more than 1.0%; Mn: not more than 10%; Cr: 20–30%; Ni: 30–55%; at least one of Mg and Ca in a total amount of 0.0010–0.0500%; W: 1.0–12.0%; either B: 0.0010–0.0100% and Zr: 0.005–0.200% or B=0.0010–0.0100%; with the balance being: Fe and incidental impurities, of which impurities P, S, and Al are restricted to: P: not more than 0.020%; S: not more than 0.010%; and Al: not more than 0.030% wherein P(%)+S(%)+Al(%) is less than 0.050%.

2. An alloy as defined in claim 1, which consists essentially of, by weight %:

C: not more than 0.15%; Si: not more than 1.0%; Mn: not more than 10%; Cr: 20–30%, Ni: 30–55%; at least one of Mg and Ca in a total amount of 0.0010–0.0500%; W: 1.0–12.0%; either B: 0.0010–0.0100% and Zr: 0.005–0.200% or B: 0.0010–0.0100%; at least one or Ti: 0.01–0.30%; Nb: 0.01–1.00%; with the balance being: Fe and incidental impurities, of which impurities P, S, and Al are restricted to: P: not more than 0.020%, S: not more than 0.0100%, and Al: not more than 0.030%, wherein P(%)+S(%)+Al(%) is less than 0.050%.

3. A structural element for use in boilers and chemical plant equipment operated at high temperature made of the alloy of claim 1.

4. A structural element for use in boilers and chemical plant equipment operated at high temperatures made of the alloy of claim 2.

5. In a boiler or chemical plant equipment operated at high temperatures including metallic structural elements, the improvement which comprises using as a metallic structural element in said boiler or chemical plant equipment the alloy of claim 1.

6. In a boiler or chemical plant operated at high temperatures including metallic structural elements, the improvement which comprises using as a metallic structural element in said boiler or chemical plant equipment the alloy of claim 2.

7. A process for improving the high temperature creep strength properties of an alloy comprising preparing an alloy consisting essentially of, by weight:

C: not more than 0.15%; Si: not more than 1.0%; Mn: not more than 10%; Cr: 20–30%; Ni: 30–55%; at least one of Mg and Ca in a total amount of 0.0010–0.0500%; W: 1.0–12.0%; either B: 0.0010–0.0100%; and Zr: 0.005% 0.200%, or B: 0.0010–0.0100%; with the balance being: Fe and incidental impurities, and process consisting essentially of restricting the P, S, contents to: P: not more than 0.020%, S: not more than 0.010%, and Al: not more than 0.030%, wherein P(%)+S(%)+Al(%) is less than 0.050%.

8. A process for improving the high temperature creep strength properties of an alloy comprising preparing an alloy consisting essentially of, by weight:

C: not more than 0.15%; Si: not more than 1.0%; Mn: not more than 10%; Cr: 20–30%; Ni: 30–55%; at least one of Mg and Ca in a total amount of 0.0010–0.0500%; W: 1.0–12.0%; either B: 0.0010–0.0100% and Zr: 0.005–0.200%, or B: 0.0010–0.0100%; at least one of Ti: 0.01–0.30%, Nb: 0.01–1.00%; and balance: Fe and incidental impurities, said process consisting essentially of restricting the P, S, and Al contents to: P: not more than 0.020%, S: not more than 0.010%, and Al: not more than 0.03%, wherein P(%)+S(%)+Al(%) is less than 0.050%.

* * * * *